US007524207B2

(12) United States Patent
Honda et al.

(10) Patent No.: US 7,524,207 B2
(45) Date of Patent: Apr. 28, 2009

(54) REINFORCING TAB, METHOD OF MANUFACTURING THE SAME AND STRUCTURE OF CONNECTING CONNECTOR USING THE SAME

(75) Inventors: Takayoshi Honda, Kariya (JP); Tadashi Tsuruzawa, Chiryu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 11/790,114

(22) Filed: Apr. 24, 2007

(65) Prior Publication Data

US 2007/0254531 A1 Nov. 1, 2007

(30) Foreign Application Priority Data

Apr. 28, 2006 (JP) ..... 2006-125732

(51) Int. Cl.
*H01R 13/73* (2006.01)

(52) U.S. Cl. ..... 439/570

(58) Field of Classification Search ..... 439/570, 439/566, 562, 563, 573; 219/76, 73; 248/205.1
See application file for complete search history.

(56) References Cited

U.S. PATENT DOCUMENTS 5,186,654 A 2/1993 Enomoto et al.
5,297,966 A * 3/1994 Brennian et al. ..... 439/64
5,788,515 A * 8/1998 Mitra et al. ..... 439/83
6,475,031 B1 * 11/2002 Wu ..... 439/570
6,478,617 B2 * 11/2002 Fan ..... 439/570
7,001,212 B1 * 2/2006 Juntwait ..... 439/566

FOREIGN PATENT DOCUMENTS

| | | |
|---|---|---|
| JP | A-6-333620 | 12/1994 |
| JP | A-11-317265 | 11/1995 |
| JP | A-2004-319229 | 11/2004 |
| JP | A-2004-319230 | 11/2004 |
| JP | A-2006-48970 | 2/2006 |
| JP | A-2006-48971 | 2/2006 |

* cited by examiner

*Primary Examiner*—Alexander Gilman
(74) *Attorney, Agent, or Firm*—Posz Law Group, PLC

(57) ABSTRACT

A reinforcing tab for reinforcing connection between a circuit board and a surface-mounted connector includes a fixing wall to be fixed to a housing of the connector and a connecting wall defining a connecting surface on its end to be connected to the circuit board. The connecting wall extends from the fixing wall and includes a bend at least at a part. Further, the connecting wall has a recess on the connecting surface at a position corresponding to the bend.

24 Claims, 10 Drawing Sheets

REINFORCING TAB, METHOD OF MANUFACTURING THE SAME AND STRUCTURE OF CONNECTING CONNECTOR USING THE SAME

CROSS REFERENCE TO RELATED APPLICATION

This application is based on Japanese Patent Application No. 2006-125732 filed on Apr. 28, 2006, the disclosure of which is incorporated herein by reference.

FIELD OF THE INVENTION

The present invention relates to a reinforcing tab for reinforcing connection between a circuit board and a surface-mounted connector, a method of manufacturing the reinforcing tab, and a connecting structure of the connector using the reinforcing tab.

BACKGROUND OF THE INVENTION

A reinforcing tab for reinforcing connection between a circuit board and a surface-mounted connector is for example disclosed in Japanese Unexamined Patent Publication No. 2004-319229. FIG. 10 shows a reinforcing tab 3 fixed to a connector 1 in the publication. The reinforcing tab 3 includes a fixing portion 5 fixed to the connector 1, extending portions 6 extending from the fixing portion 5 and connecting portions 4 at the ends of the extending portions 6 to be connected to a circuit board. The connecting portions 4 are bent from the extending portions 6 so as to increase a connecting area with the circuit board and maintain sufficient connecting strength.

The reinforcing tab 3 is fixed to the connector 1 such that the fixing portion 5 is received in a fixing portion 1*a* of a housing of the connector 1. In this condition, the bottom surfaces of the connecting portions 4 are connected with solder mounted on surfaces of lands of the circuit board. Thus, the reinforcing tab 3 reinforces the connected state of the connector 1 and the circuit board.

Such a reinforcing tab 3 is for example formed by punching and bending. FIGS. 11A to 13B show examples of the reinforcing tab 3 formed by punching and bending. In FIGS. 11A to 13B, parts having similar functions as the reinforcing tab 3 shown in FIG. 10 are designated with like reference numerals.

First, a metallic plate is stamped such that a tab base member having the shape shown in FIG. 11A is formed. Then, the connecting portions 4 are bent by applying forces as shown by arrows in FIGS. 11B and 11C. At this time, however, the connecting portions 4 will have protrusions or expansions 4*b* on the ends of a bent portion 4*a*, as shown in FIGS. 12A to 12C.

As shown in FIGS. 13A and 13B, when this connecting portion 4 is connected to a land 7 of a circuit board, a connecting surface 4*c* of the connecting portion is separated from the land 7 due to the protrusion 4*b*. As a result, a connecting area between the connecting surface 4*c* and the land 7 is reduced, and hence the connection between the reinforcing tab 3 and the circuit board will be degraded.

SUMMARY OF THE INVENTION

The present invention is made in view of the foregoing matter, and it is an object of the present invention to provide a reinforcing tab capable of improving connection between a connector and a circuit board. It is another object of the present invention to provide a method of manufacturing the reinforcing tab capable of improving connection between a connector and a circuit board. It is another object of the present invention to provide a connecting structure of a connector to a circuit board using the reinforcing tab.

According to an aspect of the present invention, a reinforcing tab for reinforcing connection between a circuit board and a surface-mounted connector includes a fixing wall to be fixed to a housing of the connector and a connecting wall that defines a connecting surface to be connected to the circuit board. The connecting wall extends from the fixing wall. The connecting wall includes a bent portion at least at a part such that the connecting wall includes a first connecting portion and a second connecting portion on opposite sides of the bent portion. Namely, the second connecting portion extends from the fixing wall and the first connecting portion extends from the second connecting portion through the bent portion. The first connecting portion defines a first connecting surface as a part of the connecting surface and the second connecting portion defines a second connecting surface as a part of the connecting surface. An end of the bent portion defines a recess that is recessed relative to the second connecting surface.

Accordingly, since the connecting wall does not have a projection or protrusion on its end surface to be connected to the circuit board at a position corresponding to the bent portion, the end surface of the connecting wall is properly connected to the circuit board. Namely, the reinforcing tab sufficiently maintains a connecting area to be connected to the circuit board, the connection between the connector and the circuit board improves.

For example, the reinforcing tab is manufactured as follows. First, a tab base member including the fixing wall and the connecting wall is punched out from a metallic plate. At this time, the recess is formed on the end surface of the connecting wall. Then, the connecting wall is bent at a position corresponding to the first recess by applying force to a portion of the connecting wall in a direction substantially parallel to the end surface. Since the connecting wall is bent at the position corresponding to the recess, the end surface of the connecting wall is not projected at the bent portion.

For example, the reinforcing tab is fixed such that the fixing wall is fixed to the housing of the connector and the connecting wall is connected to a land of the circuit board by a joining material such as solder. In this case, the width of the connecting wall reduces at the bent portion due to the recess. Therefore, this structure restricts heat from of the connecting wall and the joining material from transferring toward the fixing wall, when connecting the connecting wall to the circuit board with the joining material. Because the joining material is easily melted, the connecting wall is properly connected to the circuit board.

According to a second aspect of the present invention, a reinforcing tab for reinforcing connection between a circuit board and a surface-mounted connector includes a fixing wall to be fixed to a housing of the connector and a connecting wall to be connected to the circuit board. The connecting wall extends from the fixing wall and defines a connecting surface at an end. The connecting wall is bent at least at a part, and thus the connecting wall includes a first connecting portion, a second connecting portion and a bent portion between the first and second connecting portion. The second connecting portion extends from the fixing wall and the first connecting portion extends from the second connecting portion through the bent portion. The first connecting portion defines a first connecting surface as a part of the connecting surface, the second connecting portion defines a second connecting surface as a part of the connecting surface. Also, the bent portion defines a third connecting surface as a part of the connecting surface. The third connecting surface is substantially coplanar at least with the second connecting surface.

Accordingly, since the bent portion provides the third connecting surface, a connecting area with the circuit board is sufficiently maintained. Also, since the third connecting surface is substantially coplanar at least with the second connecting surface, the connecting wall is properly connected to the circuit board. Thus, the connection between the connector and the circuit board improves.

The reinforcing tab is for example manufactured as follows. First, a tab base member including the fixing wall and the connecting wall is punched out from a metallic plate. Then, the connecting wall is bent at least at a part by applying a force in a direction substantially parallel to the end surface of the connecting wall. Thereafter, the end surface is flattened. Accordingly, even if the end surface of the connecting wall is protruded at the end of the bent portion, it can be flattened. Thus, the third connecting wall provided by the end of the bent portion is substantially coplanar with the second connecting surface.

The reinforcing tab is fixed such that the fixing portion is fixed to a housing of the connector and the connecting surface is connected to a land of the circuit board with a joining material. Since the third connecting surface and the second connecting surface are substantially coplanar, the connecting wall is properly connected to the land. Therefore, the connection between the connector and the circuit board improves.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXAMPLE EMBODIMENT

Figure 1A:
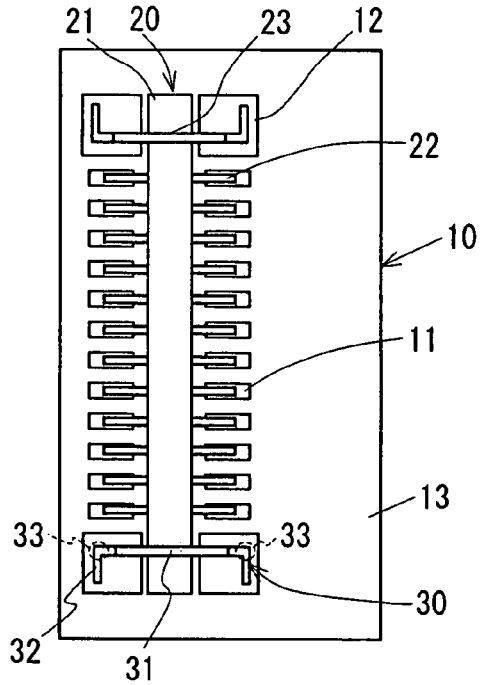
FIG. 1A is a top view of a connector that is mounted to a circuit board and reinforced through a reinforcing tab according to an embodiment of the present invention.
Figure 1B:
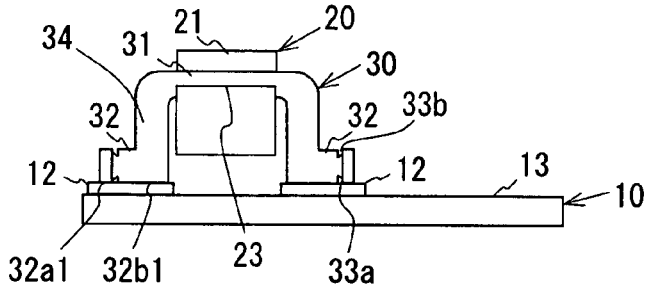
FIG. 1B is a side view of the connector shown in FIG. 1A.
Figure 1C:
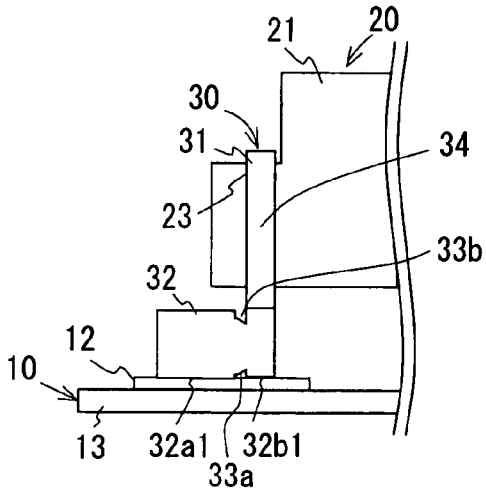
FIG. 1C is an enlarged side view of a part of the connector shown in FIG. 1A.

An embodiment of the present invention will be described with reference to FIGS. 1A to 4C. Referring to FIGS. 1A to 1C, first, a connecting structure of a connector 20 and a circuit board 10 using reinforcing tabs 30 will be described.

The circuit board 10 includes a printed circuit board 13 on which wiring patterns and via holes for connecting the wiring patterns are formed. Electronic components such as a microcomputer, power transistors, resistors, capacitors (not shown) and the connector 20 as an input/output part to be connected with external devices are mounted on the printed circuit board 13. Also, the circuit board 10 includes terminal lands 11 to which terminals 22 of the connector 20 are connected and reinforcing lands 12 to which connecting portions 32 of the reinforcing tabs 30 are connected, on a surface of the printed circuit board 13. Further, joining materials such as solder (not shown) are formed on surfaces of the terminal lands 11 and the reinforcing lands 12.

The connector 20 is a surface-mounted type connector, and includes a housing 21 and the terminals 22. The terminals 22 are made of an electrical conductive material. The housing 21 is made of an electrical insulating material (e.g., synthetic resin). The terminals 22 are arranged in the housing such that first ends thereof are surface-mounted to the circuit board 10 and second ends thereof are disposed to be connectable with the external devices. The housing 21 has housing fixing portions 23 on its end surfaces with respect to a longitudinal direction, and to which the reinforcing tabs 30 are fixed so as to improve joining strength between the circuit board 10 and the connector 20.

The terminals 22 are fixed to the housing 21 such as by inserting. The terminals 22 are arranged at equal intervals with respect to the longitudinal direction of the housing 21 without interfering with each other.

The housing fixing portions 23 are configured to receive the reinforcing tabs 30 from top side. For example, the reinforcing tabs 30 can be fixed on the housing fixing portions 23 toward the circuit board 10, as shown in FIGS. 1B and 1C. The reinforcing tabs 30 have tab fixing portions 31 to be engaged with the housing fixing portion 23. Thus, each reinforcing tab 30 is fixed to the housing 21 such that the tab fixing portions 31 and the housing fixing portion 23 are engaged with a predetermined strength.

The reinforcing tabs 30 are provided to bias the connector 20 toward the circuit board 10 so as to improve reliability of connection between the connector 20 and the circuit board 10. As shown in FIG. 1B, each of the reinforcing tabs 30 includes the tab fixing portion (fixing wall) 31 and the connecting portions (connecting walls) 32 extending from the tab fixing portion 31 through extending portions 34. The connecting portions 32 are connected to the tab fixing portion 31 through the extending portions 34. For example, the reinforcing tab 30 has a generally U-shape when viewed along the longitudinal direction of the housing 21.

The extending portions 34 extends substantially perpendicular to the tab fixing portion 31. The connecting portions 32 extend substantially perpendicular to the extending portions 34. Further, the connecting portion 32 provides a connecting surface on its end surface that is on a side opposite to the tab fixing portion 31 with respect to the extending portion 34. The connecting surface extends substantially parallel to the surface of the circuit board 10. The reinforcing tab 30 is connected to the circuit board 10 through the connecting surface.

As shown in FIG. 1A, each connecting portion 32 is bent at a bent portion 33 and thus has a substantially L-shape. In other words, the connecting portion 32 includes a first connecting portion 32*a* and a second connecting portion 32*b* between the first connecting portion 32*a* and the extending portion 34. The connecting surface is provided by end surfaces 32*a*1, 32*b*1 of the first connecting portion 32*a* and the second connecting portion 32*b*. Hereafter, the end surface of the first connecting portion 32*a* is referred to as a first connecting surface 32*a*1 and the end surface of the second connecting portion 32*b* is referred to as a second connecting surface 32*b*1.

Further, the connecting portion 32 is formed with a first groove (recess) 33*a* and a second groove (recess) 33*b* at positions corresponding to ends of the bent portion 33. Namely, the first groove 33*a* is formed on the connecting surface, between the first connecting surface 32*a*1 and the second connecting surface 32*b*1. The second groove 33*a* is formed on an end surface of the connecting portion, which is opposite to the connecting surface. Thus, the end surfaces of the connecting portion 32 do not have projections or expansions, which are formed by bending the connecting portion 32 at the bent portion 33.

The connector 20 is mounted to the circuit board 10 in the following manner. First, the reinforcing tab 30 is fixed to the housing fixing portion 23 of the connector 20. Specifically, as shown in FIG. 1C, the tab fixing portion 31 is received by the housing fixing portion 23 such that the extending portions 34 are substantially perpendicular to the circuit board 10 and the first and second connecting surfaces 32*a*1, 32*b*1 are substantially parallel to the circuit board 10.

Next, the terminals 22 of the connector 20 are soldered with the terminal lands 11 of the circuit board 10 such as by reflow soldering. Also, the connecting portions 32 of the reinforcing tab 30 are soldered with the reinforcing lands 12 such as by reflow soldering. As such, the connector 20 is mounted to the circuit board 10.

Since the connector 20 is biased toward the circuit board 10 by the reinforcing tabs 30, the connecting strength between the connector 20 and the circuit board 10 is improved. In this case, the first grooves 33*a* are formed at the ends of the bent portions 33. In other words, the connecting surface do not have projections at the positions corresponding to the bent portions 33. Therefore, the first and second connecting surfaces 32*a*1, 32*b*1 are properly soldered with the reinforcing lands 12. Accordingly, the reinforcing tabs 30 are connected to the circuit board 10 while sufficiently maintaining connecting areas with the circuit board 10. As a result, the connector 20 is connected to the circuit board 10 with a sufficient strength.

For example, the circuit board 10 on which the connector 20 is mounted is employed to an electronic device such as a control unit for a vehicle. In this case, it is generally subjected to high temperature, and thus the housing 21 and the circuit board 10 will be deformed by thermal expansion. Further, in a case that the housing 21 and the circuit board 10 are made of different materials having different coefficient of thermal expansion, the housing 21 and the circuit board 10 are likely to be displaced relative to each other. For example, the amount of displacement increases with a distance from the center of the housing 21. That is, the ends of the housing 21 with respect to the longitudinal direction is likely to more displace relative to the circuit board 10, and receive stress easily.

In this embodiment, the housing fixing portions 23 are formed on the ends of the housing 21 with respect to the longitudinal direction, and the reinforcing tabs 30, which is connected to the reinforcing lands 12 of the circuit board 10, are fixed to the housing fixing portions 23. Therefore, the connecting condition between the connector 20 and the circuit board 10 is sufficiently maintained.

The fixing direction of the reinforcing tabs 30 to the connector 20 may be decided in view of a direction in which the circuit board 10 on which the connector 20 and the reinforcing tabs 30 are mounted is carried and/or a direction in which heat is applied, during the reflow soldering, for soldering the terminals 22 and the connecting portions 32 with the terminal lands 11 and the reinforcing lands 12, respectively.

For example, during the reflow soldering, reflow heat is applied in the longitudinal direction of the connector 20 from a top of the circuit board 10, and the circuit board 10 is carried in a left direction in FIG. 1A. In this case, the first connecting portions 32*a* easily receive the solder, and thus the reinforcing tabs 30 and the connector 20 are not easily moved. Namely, since the first connecting portions 32*a* extend in a direction perpendicular to the direction in which the circuit board 10 is carried, the first connecting portions 32*a* easily catch the solder. Also, the connector 20 can be connected to the circuit board 10 in view of the direction in which the circuit board 10 is carried during the reflow soldering.

Next, structure of the reinforcing tabs 30 will be described more in detail. The reinforcing tabs 30 are formed by shaping a metallic plate into a predetermined shape such as by punching and bending. The metallic plate is for example made of copper such as brass. For example, the metallic plate can be primarily coated with nickel and then coated with tin.

Figure 2A:
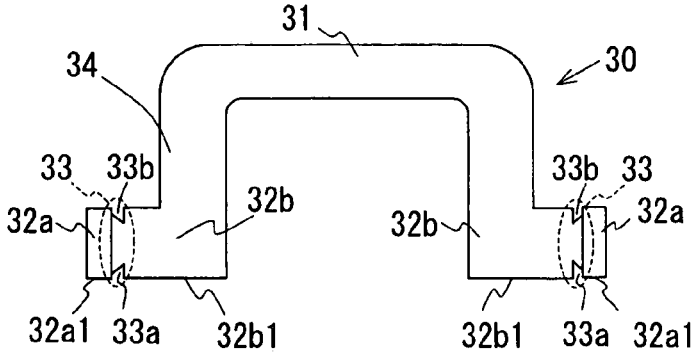
FIG. 2A is a plan view of the reinforcing tab according to the embodiment.
Figure 2B:
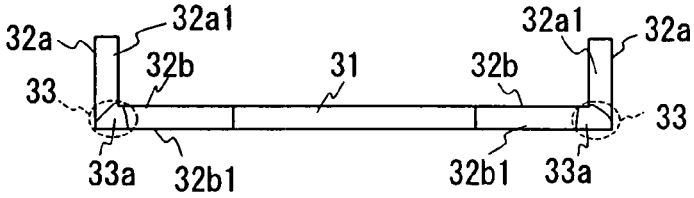
FIG. 2B is a bottom view of the reinforcing tab shown in FIG. 2A.
Figure 2C:
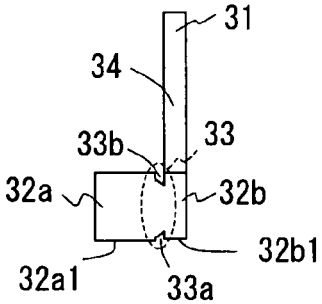
FIG. 2C is a side view of the reinforcing tab shown in FIG. 2A.

As described in the above, each reinforcing tab 30 includes the tab fixing portion 31, the extending portions 34 and the connecting portions 32. When viewed from a bottom, as shown in FIG. 2B, the reinforcing tab 30 has a substantially U-shape. Also, when viewed from a side, as shown in FIG. 2C, the reinforcing tab 30 has a substantially L-shape.

The tab fixing portion 31 is inserted to the housing fixing portion 23 from the top side and fixed to the housing 21 in a condition that the engagement between the housing fixing portion 23 and the tab fixing portion 31 is maintained in the predetermined strength. The extending portions 34 extend from ends of the tab fixing portion 31 substantially perpendicular to the tab fixing portion 31.

The connecting portions 32 are located at the ends of the extending portions 34 on the side opposite to the tab fixing portion 31. Thus, the reinforcing tab 30 is connected to the circuit board 10 at two positions. Here, each connecting portion 32 is bent at the bent portion 33 so as to increase the connecting area with the circuit board 10.

The second connecting portion 32*b* extends from the extending portion 34 in a direction substantially parallel to the tab fixing portion 31. The first connecting portion 32*a* connects to the second connecting portion 32*b* through the bent portion 33. For example, the second connecting portion 32*b* extends in a direction perpendicular to the longitudinal direction of the housing 21. The first connecting portion 32*a* extends in a direction substantially parallel to the longitudinal direction of the housing 21.

The first connecting portion 32*a* has the first connecting surface 32*a*1 on its lower end that is opposed to the circuit board 10, and the second connecting portion 32*b* has the second connecting surface 32*b*1 on its lower end that is opposed to the circuit board 10. The first connecting surface 32*a*1 and the second connecting surface 32*b*1 connect to each other through the bent portion 33.

Figure 2D:
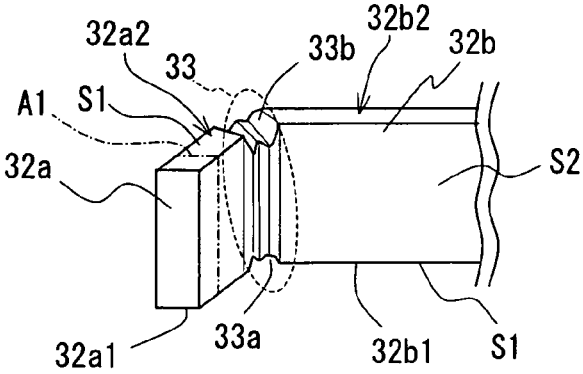
FIG. 2D is an enlarged view of a connecting portion of the reinforcing tab shown in FIG. 2A.

The connecting portion 32 has a rectangular shape in a cross-section defined in a direction perpendicular to its axis, e.g., in a cross-section taken along a dashed chain line A1 in FIG. 2D. The first and second connecting surfaces 32*a*1, 32*b*1 and the end surfaces 32*a*1, 32*b*2, which are on the side opposite to the first and second connecting surfaces 32*a*1, 32*b*1, extend along the short side of the rectangular shape of the cross-section. Hereafter, the surfaces 32*a*1, 32*b*1, 32*a*1, 32*b*1 are also referred to as first surfaces S1.

Also, surfaces of the connecting portion 32 that extend along the long side of the rectangular shape of the cross-section are substantially coplanar with surfaces of the extending portion 34 and the fixing portion 31 before the connecting portion 32 is bent at the bent portion 33. After the connecting portion 32 is bent at the bent portion 33, the surfaces of the second connecting portion 32*b* that extend along the long side of the rectangular shape of the cross-section are substantially coplanar with the surfaces of the extending portion 34 and the fixing portion 31, and these surfaces are also referred to as second surfaces S2, hereafter.

The first groove 33*a* is formed on the lower end of the bent portion 33 and has a length in a direction in which a thickness of the metallic plate forming the reinforcing tab 30 is measured. That is, the first groove 33*a* extends in a direction in which the thickness of the metallic plate is measured.

In a condition that the first connecting portion 32*a* is bent relative to the second connecting portion 32*b*, the inner surfaces of the first groove 33*a* are recessed from the first and second connecting surfaces 32*a*1, 32*b*1. In other words, the first and second connecting surfaces 32*a*1, 32*b*1 are coplanar and do not have projections between them.

In a case that a metallic plate member without having a groove such as the first groove 33*a* on its end surface is bent, a portion corresponding to the end of the bent portion is likely to expand or project. If a connecting portion having such a projection on the end surface is connected to the circuit board 10, a first connecting surface and a second connecting surface are separated from the circuit board 10 due to the projection. As a result, the connecting area between the connecting portion and the circuit board reduces.

In this embodiment, since the first groove 33*a* is formed at the position corresponding to the lower end of the bent portion 33, it is less likely that such a projection will be formed when bending the connecting portion 32. Therefore, the first and second connecting surfaces 32*a*1, 32*b*1 are sufficiently connected to the circuit board 10. Accordingly, the connection between the reinforcing tab 30 and the circuit board 10 improves.

Further, the connecting portion 32 has the second groove 33*b* on the side opposite to the first groove 33*a*. The second groove 33*b* extends in the direction in which the thickness of the metallic plate is measured, similar to the first groove. Thus, the connecting portion 32 is easily bent at the bent portion 33. However, the second groove 33*b* is not always necessary.

In the above example, each connecting portion 32 has the substantially L-shape, as shown in FIG. 2B. However, the shape of the connecting portion 32 may not be limited to the L-shape. For example, the connecting portion 32 may be bent such that the bent portion 33 has an arc or curve. Further, it is not always necessary that the first connecting portion 32*a* extends substantially perpendicular to the second connecting portion 32*b*.

Figure 3A:
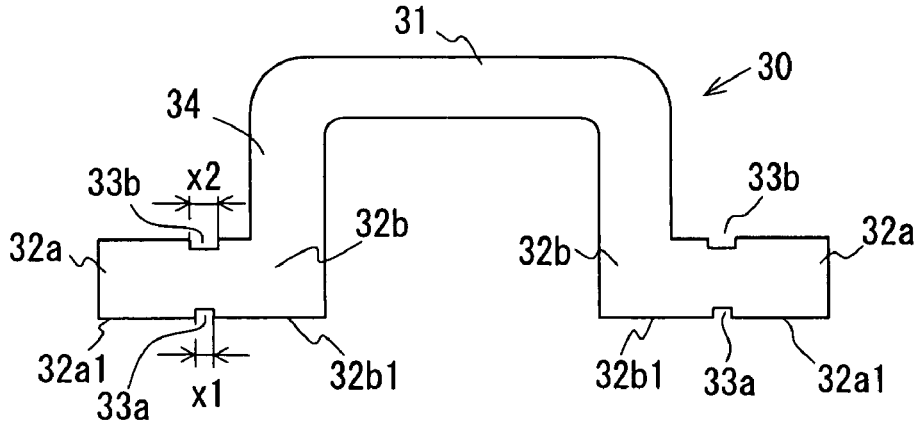
FIG. 3A is a plan view of the reinforcing tab before connecting portions are bent according to the embodiment.

Next, a method of manufacturing the reinforcing tab 30 will be described. First, as shown in FIG. 3A, a base member for the reinforcing tab 30 is formed by punching from the metallic plate. The base member has a predetermined shape including the tab fixing portion 31, the extending portions 34 and the connecting portions 32. Also, the base member has the first and second grooves 33*a*, 33*b* extending in the direction in which the thickness of the metallic plate is measured.

Figure 3B:
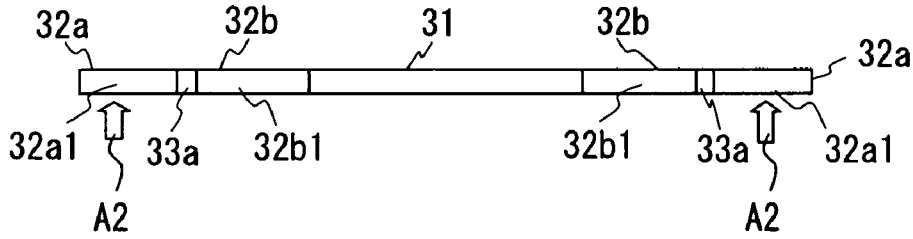
FIG. 3B is a bottom view of the reinforcing tab shown in FIG. 3A.
Figure 3C:
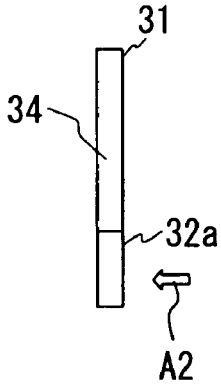
FIG. 3C is a side view of the reinforcing tab shown in FIG. 3A.

Then, as shown in FIGS. 3B and 3C, force (arrows A2) is applied to portions of the base member, which correspond to the first connecting portions 32*a*, in a direction perpendicular to the base member such that the connecting portions 32 are bent at the positions corresponding to the first and second grooves 33*a*, 33*b*. That is, in this bending step, the force is applied to each first connecting portion 32*a* in the direction substantially parallel to the first and second connecting surfaces 32*a*1, 32*b*1 such that the first connecting portion 32*a* is moved about a line passing through the first and second grooves 33*a*, 33*b*. As such, the bent portions 33 are formed.

Accordingly, since the first and second grooves 33*a*, 33*b* are formed before the bending, it is less likely that the ends of the bent portions will be projected outwardly from the connecting surface. As such, the first and second connecting surfaces 32*a*1, 32*b*1 are properly connected to the circuit board 10 without causing clearances between the first and second connecting surfaces 32*a*1, 32*b*1 and the circuit board 10. Thus, the reinforcing tabs 30 that provide reliable connections with the circuit board 10 are manufactured.

In the example shown in FIG. 3B, the first groove 33*a* extends with a constant width in the direction in which the thickness of the base member is measured. That is, the width of the first groove 33*a* on the lower surface in FIG. 3B, which corresponds to an outer side of the bent, is equal to the width of the first groove 33*a* on the upper surface in FIG. 3B, which corresponds to an inner side of the bent. Thus, the first groove 33*a* is easily formed only by punching.

On the other hand, the width of the first groove 33*a* may be increased in the direction that the force is applied. Namely, the width of the first groove 33*a* may be increased from the lower surface, which corresponds to the outer side of the bent, toward the upper surface, which corresponds to the inner side of the bent. Thus, when the reinforcing tab 30 is viewed from the bottom as in FIG. 3B, the first groove 33*a* has a trapezoidal shape, for example. In this case, the connecting portions 32 are easily bent.

Also, since the first and second groove 33*a*, 33*b* are formed on sides of the connecting portion 32, a width of the connecting portion 32 is reduced at the positions corresponding to the first and second grooves 33*a*, 33*b*. Therefore, this narrowed portion reduces heat of the solder and the connecting portion 32 from transferring toward the tab fixing portion 31 during the reflow soldering. As such, the solder to be connected with the connecting portions 32 is easily melted during the reflow soldering. Accordingly, the reinforcing tab 30, which is capable of improving the quality of soldering, is produced.

Further, as shown in FIG. 3A, a width X2 of the second groove 33*b* may be greater than a width X1 of the first groove 33*a*. In this case, when the connecting portion 32 is bent at the bent portion 33, the first connecting portion 32*a* is easily inclined relative to a plane along which the second connecting surface 32*b*1 extends. That is, the first connecting portion 32*a* is easily inclined to separate from the circuit board 10.

It is preferable that both of the first connecting surface 32*a*1 and the second connecting surface 32*b*1 are connected to the circuit board 10. However, there may be possibility that the first connecting surface 32*a*1 or the second connecting surface 32*b*1 is separated from the circuit board 10 for some reason, which may be caused when the reinforcing tab 30 is formed or when the reinforcing tab 30 is fixed to the housing 21.

Figure 4A:
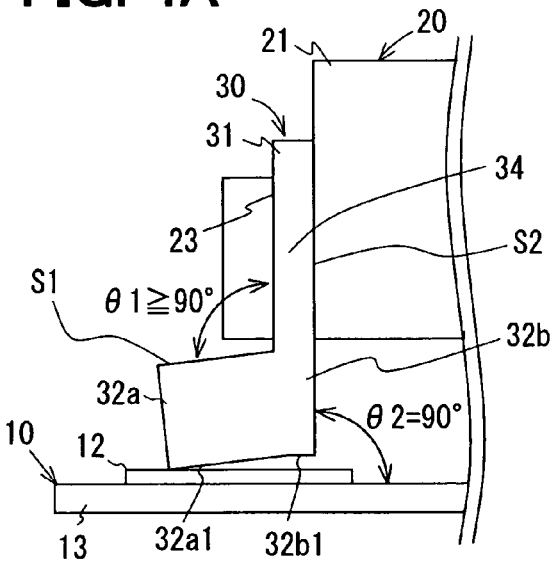
FIGS. 4A and 4B are explanatory side views of a connector and a reinforcing tab connected to a circuit board as comparative examples.

For example, as shown in FIG. 4A, the above situation occurs when the first surface S1 is angled relative to the second surface S2 equal to or more than 90° ($\theta 1 \geqq 90°$) in forming the reinforcing tab 30 (e.g., in the punching or in the bending). When this reinforcing tab 30 is fixed to the connector 20 such that the second surface S2 is approximately 90° relative to the surface of the circuit board 10 (i.e., $\theta 2 = 90°$), the second connecting surface 32*b*1 is separated from the circuit board 10.

Further, the above situation also occurs even in the reinforcing tab 30 in which the angle θ1 between the first surface S1 and the second surface S2 is approximately 90°. For example, as shown in FIG. 4B, if the reinforcing tab 30 is fixed to the connector 20 such that the second surface S2 is inclined relative to a direction perpendicular to the surface of the circuit board 10 (i.e., $\theta 2 \geqq 90°$), the second connecting surface 32*b*1 is separated from the circuit board 10.

Figure 4B:
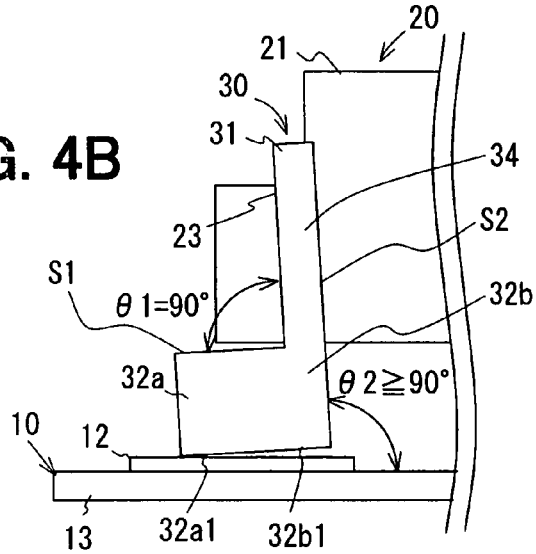
Figure 4C:
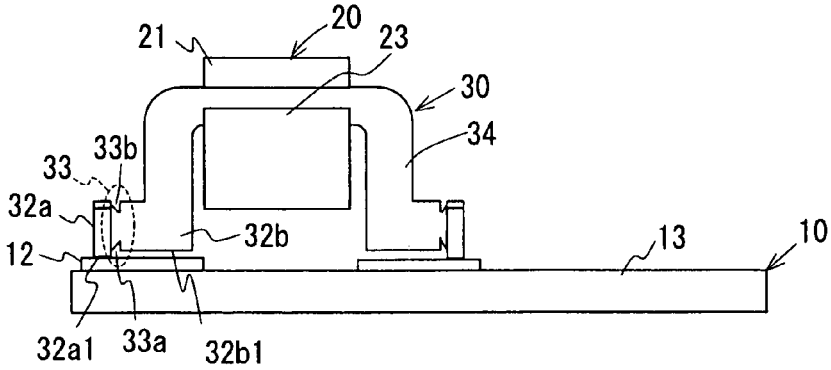
FIG. 4C is an end view of the connector and the reinforcing tab shown in FIGS. 4A and 4B.

FIG. 4C shows a front view of the reinforcing tab 30 shown in FIGS. 4A and 4B. In these cases, although the first connecting surfaces 32*a*1 are connected to the circuit board 10, the second connecting surfaces 32*b*1 are separated from the circuit board 10. Thus, the reinforcing tab 30 is less stable, as compared with a case in which the second connecting surfaces 32*b*1 are connected to the circuit board 10 but the first connecting surfaces 32*a*1 are separated from the circuit board 10. Namely, the second connecting surfaces 32*b*1 are essential portions for stably connecting the reinforcing tab 30 with the circuit board 10.

On the other hand, when the connecting portion 32 is formed such that first connecting surface 32*a*1 is inclined to separate from the circuit board 10 such as by means shown in FIG. 3A (X2>X1), the connection of the second connecting surface 32*b*1 to the circuit board 10 is enhanced. Thus, the reinforcing tab 30 is more stably connected to the circuit board 10, as compared with the examples shown in FIGS. 4A to 4C. As such, the connection between the connector 20, the reinforcing tab 30 and the circuit board 10 improve.

Other examples of the connecting structure of the reinforcing tab 30 to the circuit board 10 will be described with reference to FIGS. 5A to 5D.

Figure 5A:
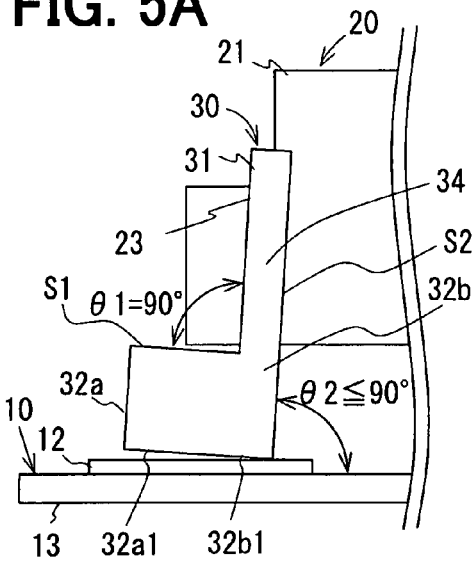
FIG. 5A to 5C are explanatory side views of the connector and the reinforcing tab connected to the circuit board for showing various examples of connecting structure according to the embodiment.

In an example shown in FIG. 5A, the angle θ1 between the first surface S1 and the second surface S2 is approximately 90°. This reinforcing tab 30 can be fixed to the connector 20 such that the angle θ2 between the second surface S2 and the circuit board 10 is equal to or less than 90°.

Figure 5B:
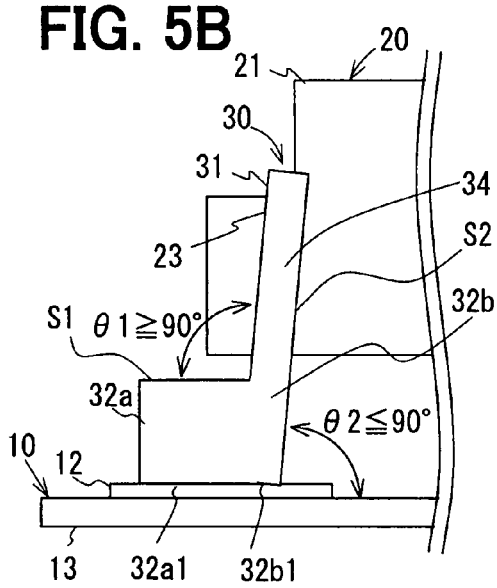

In an example shown in FIG. 5B, the angle θ1 between the first surface S1 and the second surface S2 is equal to or greater than 90°. This reinforcing tab 30 can be fixed to the connector 20 such that the angle θ2 between the second surface S2 and the circuit board 10 is equal to or less than 90°.

Figure 5C:
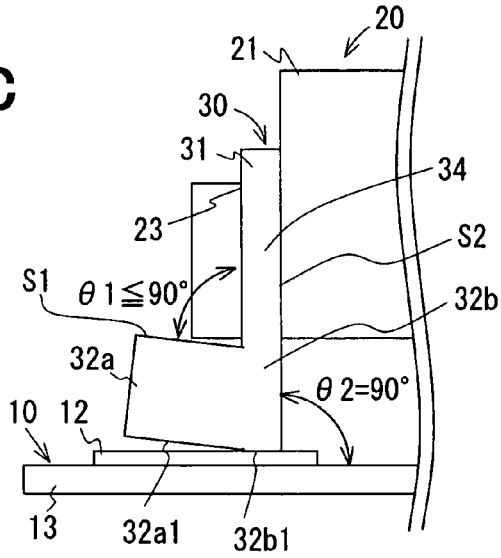

In an example shown in FIG. 5C, the angle θ1 between the first surface S1 and the second surface S2 is equal to or less than 90°. This reinforcing tab 30 can be fixed to the connector 20 such that the angle θ2 between the second surface S2 and the circuit board 10 is approximately 90°.

Figure 5D:
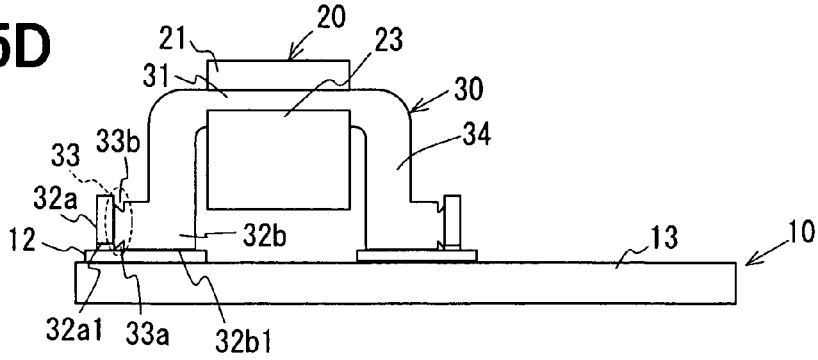
FIG. 5D is an end view of the connector and the reinforcing tab shown in FIGS. 5A to 5C.

In the examples shown in FIGS. 5A to 5C, at least the second connecting surface 32*b*1 is connected to the circuit board 10, even though the first connecting surface 32*a*1 is separated from the circuit board 10, as shown in FIG. 5D. Thus, the reinforcing tab 30 is more stably connected to the circuit board 10, as compared with the case in which the reinforcing tab 30 is connected to the circuit board 10 only through the first connecting surfaces 32*a*1. Accordingly, even in the embodiments shown in FIGS. 5A to 5C, the connection between the connector 10, the reinforcing tab 30 and the circuit board 10 improves.

Further, the connecting portion 32 can be modified. FIGS. 6A to 6F show examples of the connecting portion 32 before the bending.

Figure 6A:
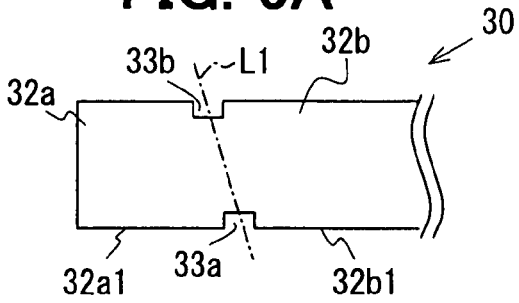
FIGS. 6A to 6F are plan views for showing various examples of the connecting portion before being bent according to the embodiment.

As shown in FIG. 6A, the first groove 33*a* and the second groove 33*b* can be formed at different positions with respect to the longitudinal direction of the connecting portion 32. Namely, the second groove 33*b* is closer to the end than the first groove 33*a*. Thus, an imaginary line L1 passing through the first groove 33*a* and the second groove 33*b* is inclined with respect to a direction perpendicular to the longitudinal direction of the connecting portion 32 before the bending.

Figure 6D:
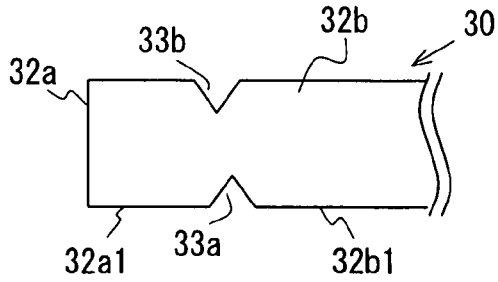
Figure 6B:
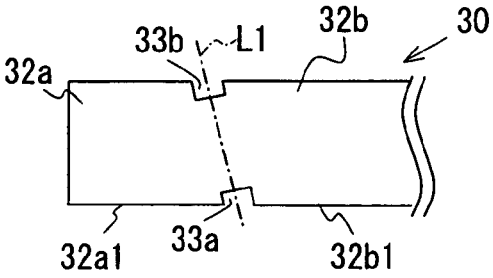

In the example shown in FIG. 6B, the second groove 33*b* is located closer to the end than the first groove 33*a*, similar to the example shown in FIG. 6A. Further, the first and second grooves 33*a*, 33*b* are inclined along the line L1 passing through the first and second grooves 33*a*, 33*b*. That is, side walls of the first and second grooves 33*a*, 33*b* are inclined along the line L1, and bottom walls of the first and second grooves 33*a*, 33*b* are also inclined.

Figure 6E:
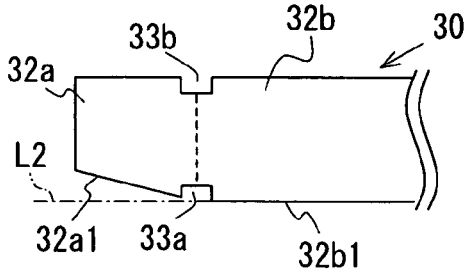
Figure 6C:
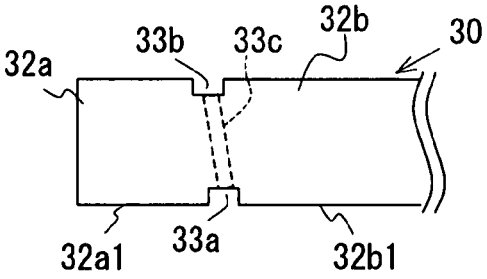

In the example shown in FIG. 6C, the second groove 33*b* is located closer to the end than the first groove 33*a*, similar to the example shown in FIG. 6A. Further, a groove 33*c* extending from the first groove 33*a* to the second groove 33*b* is formed on a surface of the connecting portion 32.

In the example shown in FIG. 6D, the second groove 33*b* is located closer to the end than the first groove 33*a*, similar to the example shown in FIG. 6A. In this case, however, the width of the first and second grooves 33*a*, 33*b* is reduced toward its bottom.

In the example shown in FIG. 6E, the first connecting portion 32*a* can be tapered such that the first connecting surface 32*a*1 is inclined relative to an imaginary line L2 extending along the second connecting surface 32*b*1. The first connecting surface 32*a*1 is inclined to separate from the line L2.

Figure 6F:
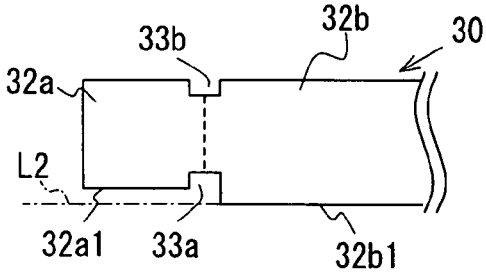

In the example shown in FIG. 6F, the first connecting surface 32*a*1 is recessed from the imaginary line L2 extending along the second connecting surface 32*b*1, such that the first connecting surface 32*a*1 is separated from the circuit board 10.

When the connecting portions 32 shown in FIGS. 6A to 6F are bent, the first connecting surface 32*a*1 is inclined relative to or separated from the plane on which the second connecting surfaces 32*b*1 are included. As such, the reinforcing tabs 30 that can enhance connection between the second connecting surfaces 32*b*1 and the circuit board 10 are provided.

Figure 7A:
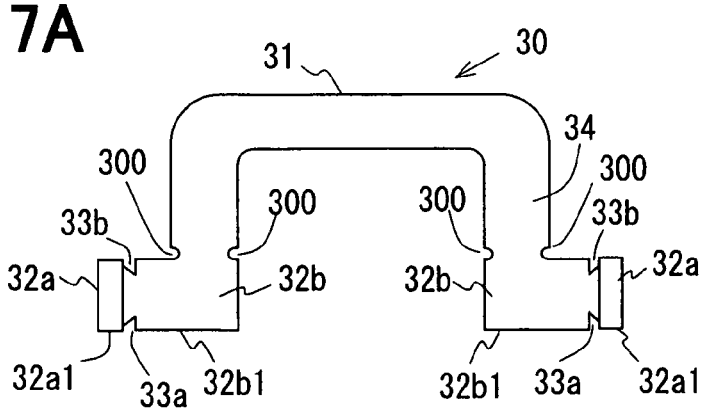
FIG. 7A is a plan view of a reinforcing tab for showing an example of extending portions according to the embodiment.

Also, the extending portions 34 of the reinforcing tab 30 can be modified. For example, as shown in FIG. 7A, the extending portions 34 are formed with narrowed portions (e.g., recesses) 300 at which the extending portions 34 are narrowed, as heat transfer restricting portions. For example, the width of the extending portions 34 at the narrowed portions 300 is smaller than the width of the fixing portion 31 and the connecting portions 32.

Since the extending portions 34 have the narrowed portion 300, the heat of the solder and the connecting portion 32 is restricted from being transferred toward the fixing portion 31 during the reflow soldering for soldering the reinforcing tab 30 with the circuit board 10. Thus, in the reflow soldering, the solder is easily melted and hence the reinforcing tab 30 is properly soldered with the circuit board 10. Here, the narrowed portions 300 can be formed at the same time as punching the base member.

Figure 8A:
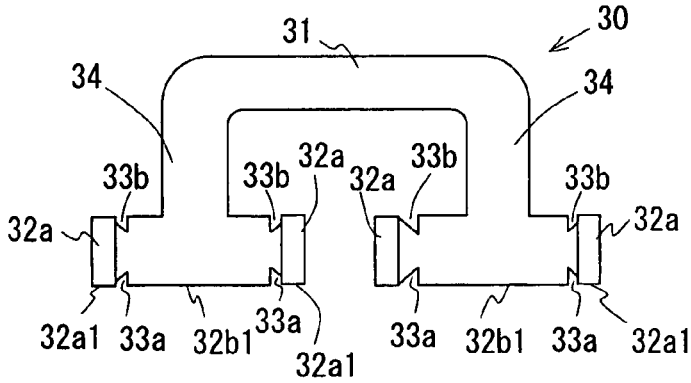
FIG. 8A is a plan view of a reinforcing tab as another example according to the embodiment.
Figure 8B:
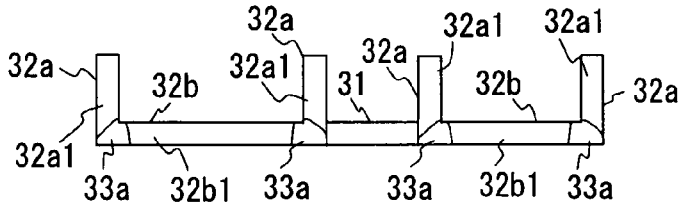
FIG. 8B is a bottom view of the reinforcing tab shown in FIG. 8A.

Further, the shape of the reinforcing tab 30 can be modified. FIGS. 8A and 8B show another example of the reinforcing tab 30. As shown in FIG. 8A, the second connecting portions 32*b*1 extend on both sides of each extending portion 34 substantially perpendicular to the extending portion 34, and the first connecting portions 32*a*1 extend from the second connecting portions 32*b*1 through the bent portions 33. Thus, each connecting portion 32 has a substantially U-shape when viewed from the bottom of the reinforcing tab 30 as shown in FIG. 8B.

In this case, the connecting area between the reinforcing tab 30 and the circuit board 10 increases. As such, the connection between the reinforcing tab 30 and the circuit board 10 improves, and hence the connector 20 is further securely connected to the circuit board 10 through the reinforcing tab 30.

Figure 9A:
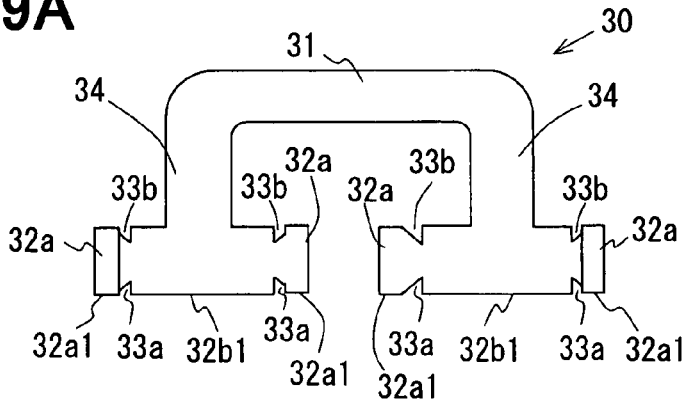
FIG. 9A is a plan view of a reinforcing tab as further another example according to the embodiment.
Figure 9B:
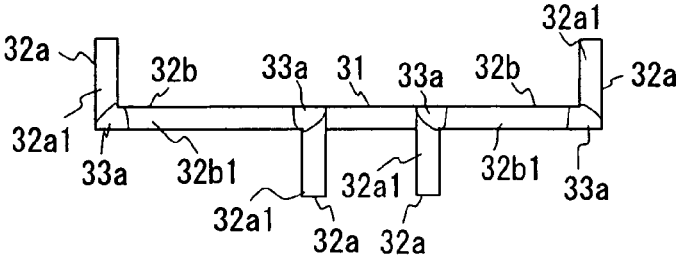
FIG. 9B is a bottom view of the reinforcing tab shown in FIG. 9A.
Figure 10:
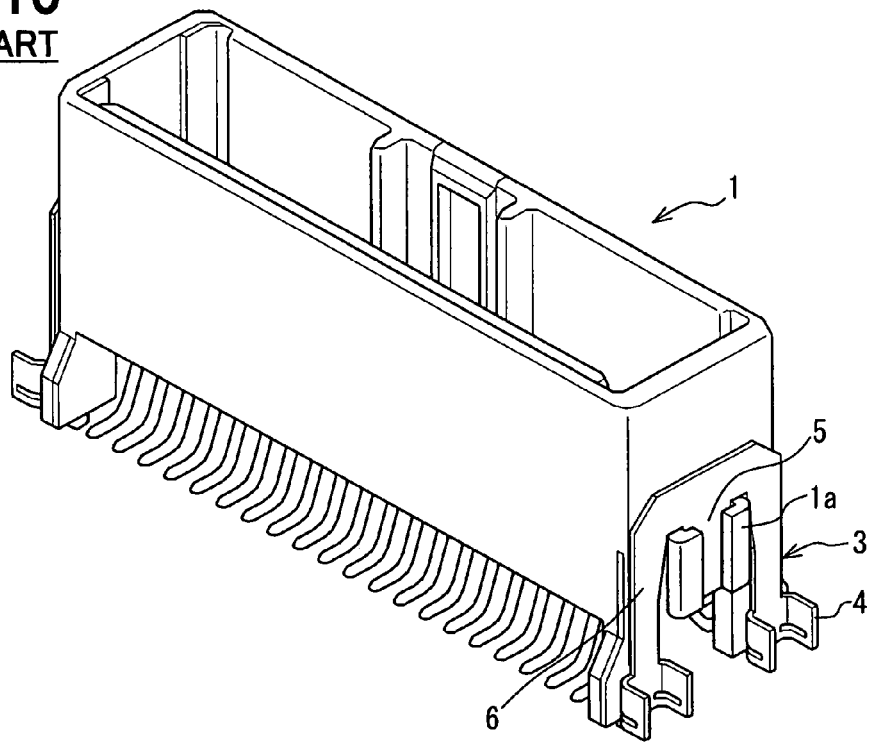
FIG. 10 PRIOR ART
FIG. 10 is a perspective view of a connector and a reinforcing tab fixed to the connector as a prior art.
Figure 11A:
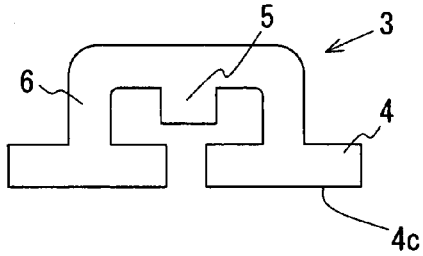
FIG. 11A RELATED ART
FIG. 11A is a plan view of a reinforcing tab before connecting portions are bent as a related art.
Figure 11B:
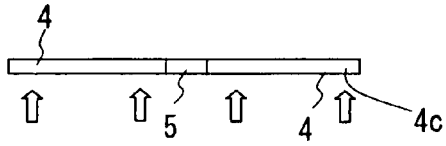
FIG. 11B RELATED ART
FIG. 11B is a bottom view of the reinforcing tab shown in FIG. 11A.
Figure 11C:
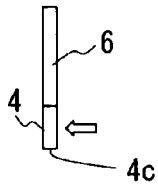
FIG. 11C RELATED ART
FIG. 11C is a side view of the reinforcing tab shown in FIG. 11A.
Figure 12A:
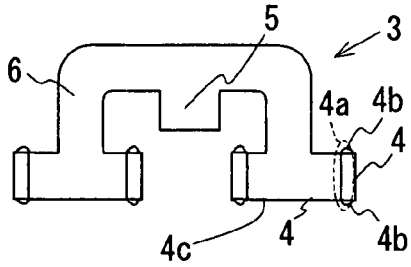
FIG. 12A RELATED ART
FIG. 12A is a plan view of the reinforcing tab shown in FIGS. 11A to 11C, after the connecting portions are bent.
Figure 12B:
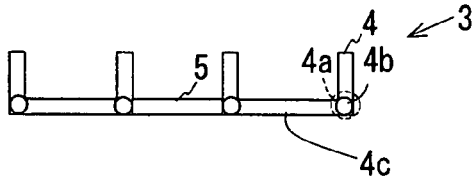
FIG. 12B RELATED ART
FIG. 12B is a bottom view of the reinforcing tab shown in FIG. 12A.
Figure 12C:
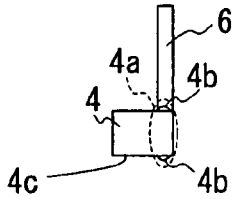
FIG. 12C RELATED ART
FIG. 12C is a side view of the reinforcing tab shown in FIG. 12A.
Figure 13A:
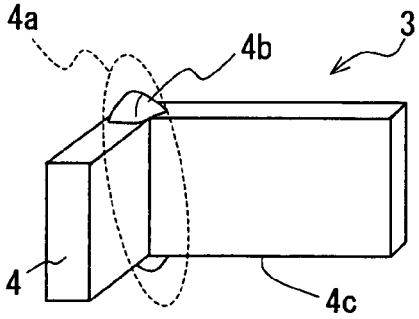
FIG. 13A RELATED ART
FIG. 13A is an enlarged view of the connecting portion of the reinforcing tab shown in FIG. 12A.
Figure 13B:
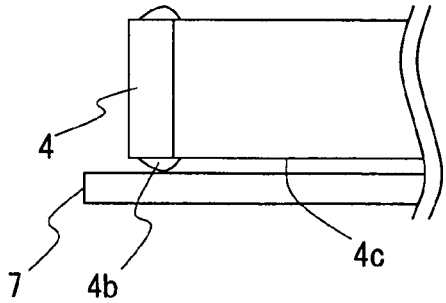
FIG. 13B RELATED ART
FIG. 13B is a side view of the connecting portion shown in FIG. 13A when connected to a circuit board.

The reinforcing tab 30 shown in FIGS. 8A and 8B can be further modified as shown in FIGS. 9A and 9B. The first connecting portion 32*a* of each connecting portion 32 can be bent in different directions. Namely, the bending directions of the first connecting portions 32*a* are changed appropriately in view of a shape of the connector 20, arrangement of the electronic components mounted on the circuit board 10, and the like. Therefore, the reinforcing tab 30 is effectively arranged on the circuit board 10.

Also, even in the case in which each connecting portion 32 has one first connecting portion 32*a*, the first connecting portions 32*a*1 of the reinforcing tab 30 can be bent in different direction. For example, in the example shown in FIGS. 2A and 2B, the first connecting portions 32*a*1 can be bent in opposite directions.

In the above discussion, each connecting portion 32 has at least one bent portion 33 and the first groove 33*a* at the end of the bent portion 33, the end facing the circuit board 10. However, the reinforcing tab 30 is not limited to the above.

Figure 7B:
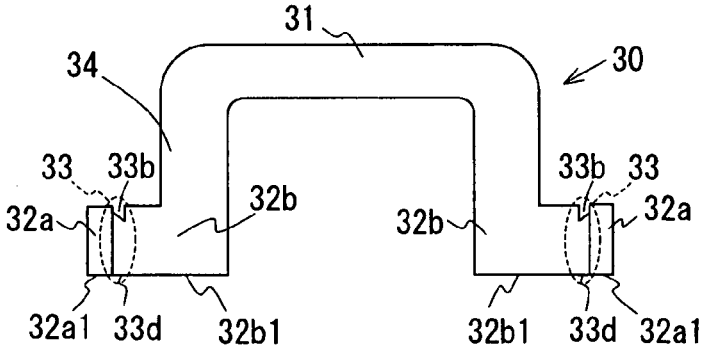
FIG. 7B is a plan view of a reinforcing tab without having a groove on a connecting surface as an example according to the embodiment.

For example, as shown in FIG. 7B, the connecting portion 32 has at least one bent portion 33 and the end of the bent portion 33 can be substantially coplanar with the second connecting surface 32*a*1, 32*b*1, instead of having the first groove 33*a*. To make such a reinforcing tab 30, first, the base member including the tab fixing portion 31, the extending portions 34 and the connecting portions 32 is formed by punching from a metallic plate made of copper such as brass. Then, each of the connecting portions 32 is bent at least at a part so that the first and second connecting surfaces 32*a*1, 32*b*1 are formed. Then, the end surface of the connecting portion 32, which is to be connected to the circuit board 10, is flattened such as by shaving or trimming.

Thus, the end surface 33*d* of the bent portion 33 is coplanar with the first and second connecting surfaces 32*a*1, 32*b*1. As such, the reinforcing tab 30 without having the projection or expansion at the end of the bent portion 33 is produced. Accordingly, the connection between the reinforcing tab 30 and the circuit board 10 improves.

Figure 7C:
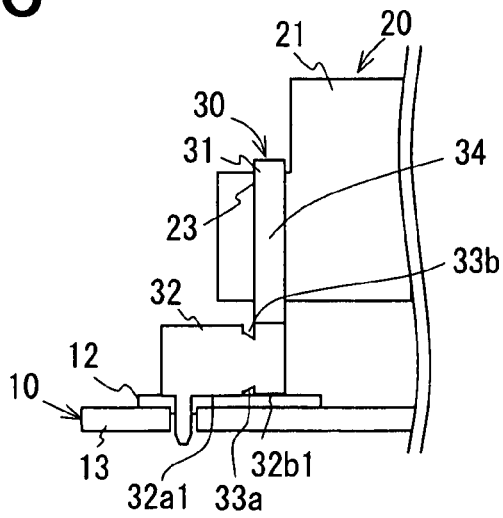
FIG. 7C is a side view of a reinforcing tab having a positioning projection on a connecting surface as an example according to the embodiment.

In the above embodiment, solder as the joining material is applied to surfaces of the lands 11, 12, and the terminals 22 and the reinforcing tabs 30 are soldered to the lands 11, 12 of the circuit board 10 in a reflow oven. Therefore, in addition to the above discussed structure, a positioning projection as disclosed in Japanese Unexamined Patent Publication No. 11-317265 may be provided. For example, as shown in FIG. 7C, the connecting portion 32 has a positioning projection that projects from the connecting surface and is received in the reinforcing land 12 and the circuit board 10. In this structure, the reinforcing tab 30 is effectively positioned relative to the circuit board 10. Further, this structure provides an effect of reducing separation of the soldered portion between the reinforcing land 12 and the connecting portion 32. As such, the connecting surface is effectively soldered to the reinforcing land 12.

The shape of the reinforcing tab 30 is not particularly limited to the illustrated shapes, but may have another shape. For example, the reinforcing tab 30 may have one extending portion 34 and one connecting portion 32 at the end of the extending portion 34. Further, the above discussed and illustrated examples may be employed with various combinations.

As discussed in the above, the connection between the connector 20 and the circuit board 10 is improved by the reinforcing tab 30. When the circuit board 10 mounting the connector 20 is employed in the electronic device for a vehicle, it generally receives stress due to heat. Even in such a condition, the connection between the connector 20 and the circuit board 10 is effectively reinforced by the reinforcing tab 30.

The example embodiments of the present invention are described above. However, the present invention is not limited to the above example embodiment, but may be implemented in other ways without departing from the spirit of the invention.

What is claimed is:

1. A reinforcing tab that reinforces a connection between a circuit board and a connector surface-mounted to the circuit board, the connector including a housing and terminals, the reinforcing tab being made from a metal plate, and comprising:

a fixing wall to be fixed to the housing; and a connecting wall extending from the fixing wall and defining a connecting surface along an edge of the connecting wall connected to the circuit board, wherein the connecting wall includes a first connecting portion, a second connecting portion and a bent portion, the second connecting portion extending from the fixing wall and the first connecting portion extending from the second connecting portion through the bent portion such that the first connecting portion is angled relative to the second connecting portion, the first connecting portion and the second connecting portion respectively define a first connecting surface and a second connecting surface as portions of the connecting surface at ends thereof, and a first recess is formed within the connecting surface at a location corresponding to the bent portion as a projection restricting recess that restricts the connecting wall from forming a projection that extends beyond the connecting surface.

2. The reinforcing tab according to claim 1, wherein the first recess is in a form of groove and extends in a direction in which a wall thickness of the connecting wall is measured.

3. The reinforcing tab according to claim 1, wherein the first connecting surface of the first connecting portion is spaced from a plane that is defined along the second connecting surface of the second connecting portion.

4. The reinforcing tab according to claim 3, wherein the first connecting surface is inclined relative to the plane such that a space increases with a distance from the bent portion.

5. The reinforcing tab according to claim 1, wherein the connecting wall defines a second recess on an end surface, which is on a side opposite to the first and second connecting surfaces, at a position corresponding to the bend portion.

6. The reinforcing tab according to claim 5, wherein the second recess defines a width that is greater than a width of the first recess.

7. The reinforcing tab according to claim 5, wherein the first recess and the second recess are in the form a first groove and a second groove respectively, and the first groove and the second groove are at different positions with respect to the longitudinal direction on the connecting wall.

8. The reinforcing tab according to claim 7, wherein the second groove is located closer to the end of the connecting wall than the first groove.

9. The reinforcing tab according to claim 8, wherein the second groove and the first groove are inclined along an imaginary line, passing through the second groove and the first groove and inclined with respect to a direction perpendicular to the longitudinal direction of the connecting wall, such that sidewalls and bottom walls of both the second groove and the first groove are inclined relative to the imaginary line.

10. The reinforcing tab according to claim 8, wherein the width of both the second groove and the first groove is reduced toward the bottom of each groove.

11. The reinforcing tab according to claim 1, wherein the connecting wall includes a heat transfer restricting portion at which a width of the connecting wall is reduced for reducing heat transfer from the connecting wall toward the fixing wall.

12. A connecting structure comprising:

the reinforcing tab according to claim 1;

a connector including a housing and terminals disposed to the housing; and a circuit board having first lands for the terminals, a second land for the reinforcing tab, and a joining material disposed on surfaces of the first and second lands, wherein the connector is mounted to the circuit board, and the terminals are connected to the first lands by the joining material, the fixing wall of the reinforcing tab is fixed to the housing, and the connecting surface of the connecting wall is connected to the second land by the joining material.

13. The structure according to claim 12, wherein the reinforcing tab is fixed in a condition that the first connecting surface is inclined relative to the surface of the second land.

14. An electronic device for a vehicle, comprising:

a circuit board having first lands and a second land;

a connector mounted on the circuit board, the connector including a housing and terminals disposed in the housing, the terminals connected to the first lands with a joining material disposed on surfaces of the first lands; and the reinforcing tab according to claim 1, wherein the fixing portion of the reinforcing tab is fixed to the housing, and the connecting wall is connected to the second land with a joining material disposed on a surface of the second land.

15. The reinforcing tab according to claim 1, wherein the connecting wall further includes a positioning projection that projects from the connecting surface to be positioned relative to the circuit board.

16. The reinforcing tab according to claim 1, wherein the first connecting portion extends from the second connecting portion through the bent portion such the connecting wall is substantially L-shaped when viewed from a plan view.

17. The reinforcing tab according to claim 1, further comprising:

a second connecting wall extending from the fixing wall, and separated from the connecting wall by the fixing wall, the second connecting wall defining an opposite connecting surface along an edge of the second connecting wall connected to the circuit board, wherein the second connecting wall includes a third connecting portion, a fourth connecting portion and a second bent portion, the fourth connecting portion extending from the fixing wall and the third connecting portion extending from the fourth connecting portion through the second bent portion such that the third connecting portion is angled relative to the fourth connecting portion, the third connecting portion and the fourth connecting portion respectively define a third connecting surface and a fourth connecting surface as portions of the opposite connecting surface at ends thereof, a third recess is formed within the opposite connecting surface at a location corresponding to the second bent portion as a projection restricting recess that restricts the second connecting wall from forming a projection that extends beyond the opposite connecting surface, and the reinforcing tab has a general U-shape when viewed along a longitudinal direction of the housing.

18. The reinforcing tab according to claim 17, wherein the first connecting portion extends from the second connecting portion through the bent portion such that the connecting wall is substantially L-shaped when viewed from a plan view, the third connecting portion extends from the fourth connecting portion through the second bent portion such that the opposite connecting wall is substantially L-shaped when viewed from a plan view, and the reinforcing tab has a general U-shape when viewed either upwardly, from below the circuit board or from a plan view.

19. The reinforcing tab according to claim 17, wherein the first connecting portion extends from the second connecting portion in a perpendicular direction from the fixing wall, the third connecting portion extends from the fourth connecting portion in a perpendicular direction from the fixing wall, and the reinforcing tab is substantially L-shaped when viewed from either side of the reinforcing tab.

20. The reinforcing tab according to claim 1, wherein the first connecting portion extends from the second connecting portion in a perpendicular direction from the fixing wall such that the reinforcing tab is substantially L-shaped when viewed from a side of the reinforcing tab.

21. The reinforcing tab according to claim 1, wherein the first recess is in a form of groove, and the groove has a trapezoidal shape when viewed from the bottom of the reinforcing tab.

22. A reinforcing tab that reinforces a connection between a circuit board and a connector mounted on the circuit board, the connector including a housing and terminals, the reinforcing tab being made from a metal plate, and comprising:

a fixing portion to be fixed to the housing; and a connecting portion, extending from the fixing portion, having a wall surface as a non-contacting surface to the circuit board and a connecting surface configured as an edge connected to the circuit board, wherein the connecting portion includes a bent portion at which the connecting portion is bent by bending the wall surface, and a recess portion is formed as a projection restricting recess at a location, defined by the wall surface and the connecting surface, in the bent portion, at which the connecting surface is notched, that restricts the connecting portion from forming a projection that extends beyond the connecting surface.

23. A reinforcing tab made from a metal plate having an edge surface therearound, the reinforcing tab reinforcing a connection between a circuit board and a housing of a connector surface-mounted to the circuit board, the reinforcing tab bent to form a reinforcing section, the reinforcing tab comprising:

a fixing wall to be fixed to the housing; and a connecting wall extending from the fixing wall and having a connecting surface including a portion of the edge surface associated with the reinforcing section, the connecting surface to be connected to the circuit board, wherein the connecting wall includes a first connecting portion and a second connecting portion extending from the first connecting portion, the second connecting portion is bent relative to the first connecting portion, the connecting surface is defined along lower edges of the first and second connecting portions, and the connecting wall includes a projection restricting recess within the connecting surface and at a location where the second connecting portion is bent relative to the first connecting portion, the projection restricting recess restricting metal that is displaced when the second connecting portion is bent relative to the first connecting portion, from forming a projection that extends beyond the connecting surface.

24. A reinforcing tab made of metal and having a flat shape, the reinforcing tab reinforcing a connection between a circuit board and a connector surface-mounted to the circuit board, the reinforcing tab comprising:

a fixing wall to be fixed to the connector; and a connecting wall extending from the fixing wall, the connecting wall having a connecting surface along a lower edge portion thereof, at least a portion of the connecting surface to be connected to the circuit board, wherein:

the connecting wall includes a first connecting portion and a second connecting portion extending from the first connecting portion;

the second connecting portion is capable of being bent relative to the first connecting portion;

the connecting surface is defined along lower edges of the first and second connecting portions; and the connecting wall includes a projection restricting recess at a location on the connecting surface where the second connecting portion is bent relative to the first connecting portion, the projection restricting recess restricting a portion of the reinforcing tab in the vicinity of the location where the second connecting portion is bent relative to the first portion from projecting beyond the connecting surface when the second connecting portion is bent relative to the first connecting portion.

* * * * *